United States Patent [19]

Stellwagen

[11] 4,057,045

[45] Nov. 8, 1977

[54] MAGNETIC PULSE TYPE IGNITION DISTRIBUTOR

[75] Inventor: Jean-Henri Stellwagen, Paris, France

[73] Assignee: Societe Anonyme pour l'Equipement Electrique des Vehicules S.E.V. Marchal, Issy les Moulineaux, France

[21] Appl. No.: 549,904

[22] Filed: Feb. 14, 1975

[30] Foreign Application Priority Data

Oct. 16, 1974 France ..... 74.34751

[51] Int. Cl.[2] ..... F02D 7/02

[52] U.S. Cl. ..... 123/146.5 A; 200/19 M; 310/70 R

[58] Field of Search ..... 123/148 R, 148 E, 146.5 A, 123/149 C, 149 R, 149 A, 149 D; 310/70 R, 70 A, 153, 154; 315/209 T, 218; 200/19 R, 19 M, 31 R; 324/16 T

[56] References Cited

U.S. PATENT DOCUMENTS

| | | | |
|---|---|---|---|
| 2,433,715 | 12/1947 | Smart et al. | 310/70 R X |
| 2,774,033 | 12/1956 | Penn | 324/16 T |
| 2,988,616 | 6/1961 | Reese | 200/19 M X |
| 3,238,416 | 3/1966 | Huntzinger et al. | 123/148 E |
| 3,463,134 | 8/1969 | Zechnall et al. | 123/146.5 A |
| 3,906,917 | 9/1975 | Lorti | 123/146.5 A |
| 3,955,550 | 5/1976 | Carlsson | 123/149 R X |

FOREIGN PATENT DOCUMENTS

| | | | |
|---|---|---|---|
| 1,538,395 | 9/1968 | France | 123/148 E |

*Primary Examiner*—Carroll B. Dority
*Assistant Examiner*—Tony M. Argenbright
*Attorney, Agent, or Firm*—Brisebois & Kruger

[57] ABSTRACT

Magnetic pulse type ignition distributor in which the magnetic pulses are produced by a pole-carrying timer core rotating in the magnetic gap between two stationary poles of a magnetic circuit. The timer core is enclosed in a sealed casing made principally of a non-magnetic metal. The stationary poles enter this casing through openings partially defined by a non-conductive material to avoid heating due to eddy currents. Means are provided for minimizing the friction produced by rotation of the timer core, and for facilitating the mounting of the casing and the remainder of the distributor in a position in which the timing is sufficiently well adjusted to permit operation of the motor.

16 Claims, 4 Drawing Figures

MAGNETIC PULSE TYPE IGNITION DISTRIBUTOR

SUMMARY OF THE INVENTION

In order to open and close the circuit supplying the primary winding of an ignition coil associated with an internal combustion engine, and particularly an automobile engine, a timer core may be used which is rotated by a shaft driven by the motor. This timer core rotates in the magnetic gap in a magnetic circuit which is equipped with a coil for transforming the variations in magnetic flux into electrical pulses. This type of magnetic pick-up is ordinarily positioned in an ignition distributor which comprises centrifugal advance means, depression responsive advance means, and a rotor arm for distributing the high voltage current received from the secondary winding of the ignition coil to the various terminals connected to the spark plugs of the motor. The terminals for distributing the secondary current are positioned on the insulating cap of the ignition distributor.

French Pat. No. 1,538,395 has already described a device of the above type in which the magnetic circuit, between the stationary poles of which the timer core rotates, is supported by the cheek plates of a casing fitted onto the shaft of the ignition distributor. In this embodiment the casing is independent of the distributor housing and centered on the shaft of the distributor, which shaft is rotated by the timer core in cylindrical bearing means which forms a component of the casing comprising the two cheek plates. The stationary poles of the magnetic circuit pass through this cylindrical bearing to emerge at diametrically opposite points facing the movable poles of the timer core carried by the shaft of the distributor. While the description of the French patent is not specific in this respect, it is obvious that the cheek plates and the cylindrical bearing of the casing are made of a non-magnetic material. It is also clear that this non-magnetic material cannot be a conductor since the ends of the stationary poles are encircled completely by this material so that, if the material were conductive, eddy currents would be produced so as to cause unacceptable local increases in the temperature. It is thus obvious that these cheek plates and the cylindrical bearing of the casing are made of a material which does not conduct electric current.

It has been found that the device described in French Pat. No. 1,538,395 has certain disadvantages when used as an ignition distributor. In particular, when the distributor shaft is driven at high speeds over a long period of time, the friction between the moving poles of the timer core and the cylindrical bearing made of plastic material generates too much heat despite the presence of a lubricating pad. This may result in the destruction of the casing by melting or fusing of the plastic material. Moreover, the use of a plastic material for manufacturing the cheek plates and the cylindrical bearing of the casing makes this casing sensitive to variations in temperature and the absorption of dampness. These two factors may lead, due to a change in the clearance between the cylindrical bearing and the timer core, to rubbing the core by the casing which results in an increase in friction and consequently the possibility of destruction due to melting of the plastic material as previously indicated. Moreover, in the embodiment illustrated in FIG. 3 of French Pat. No. 1,538,395, the stationary magnetic poles carried by the cheek plates of the casing are engaged in notches in the cylindrical bearing and many, in response to vibrations of the motor, become displaced to an extent such that they may come in contact with the moving poles of the timer core or increase the magnetic gap in the magnetic circuit, the operation of which is then disturbed.

Finally, because the timer core rotates in a cylindrical chamber defined by the cylindrical bearing of the casing which is open at its two ends, the magnetic gap in the magnetic circuit is not protected against the penetration of particles of magnetic material. This produces a disturbance in the operation of the magnetic pick-up which is difficult to detect and consequently a disturbance in the operation of the ignition control.

It is the object of the present invention to propose an improved ignition distributor of the type described in French Pat. No. 1,538,395, which distributor comprises a magnetic pick-up which avoids the above-mentioned disadvantages. According to the invention, the casing which carries the magnetic pick-up is centered on the shaft of the ignition distributor and carried on said shaft in such a way as to avoid any direct friction between the timer core and the casing. For this purpose the invention proposes to position the bearings on opposite sides of the timer core in alignment with the cheek plates of the casing, these bearings having the additional advantage of insulating the magnetic gap in which the timer core rotates from the exterior of the casing.

The present invention accordingly relates to a new article of manufacture which consists of an ignition distributor comprising, in the first place, a casing in which a shaft driven by the motor rotates, said casing being closed at one end by an insulating distributor cap which carries the terminals for distributing the high voltage current produced by the ignition coil associated with the distributor; in the second place, a pick-up assembly carried by the distributor shaft and in which said shaft rotates, said pick-up assembly comprising a magnetic circuit, the stationary poles of which are positioned in alignment with a timer core carried by the distributor shaft, an induction coil cooperating with said magnetic circuit and supplying electric pulses controlling the opening and closing of the supply circuit for the primary winding of the ignition coil associated with the ignition distributor, and two substantially parallel cheek plates; and, in the third place, a rotor arm driven by the distributor shaft which conducts the high voltage current supplied by the secondary winding of the ignition coil associated with the distributor to the terminals connected to the spark plugs of the motor associated with the distributor. This distributor is characterized by the fact that two bearing surfaces each of which is in alignment with one of the cheek plates, are provided on opposite sides of the timer core of the distributor, a rotary member being positioned between said bearing surfaces and the cheek plates of the pick-up assembly.

In a preferred embodiment of the invention, the bearing surfaces in alignment with each of the cheek plates of the pick-up assembly are fixed to the timer core. The rotary member associated with each of the cheek plates is a bearing ring made of a non-magnetic material, for example, sintered bronze, and the corresponding cylindrical bearing surface of the timer core rotates inside said ring. The pick-up assembly is a casing comprising two cheek plates connected to each other by a spacer member, one edge of which defines at least partially the cylindrical chamber within which the timer core rotates. The casing is made of a single piece molded from a non-magnetic material, a chamber receiving the timer core being delimited in the central part of the casing, partially by the spacer member which connects the two cheek plates and partially by an arcuate sealing member of non-magnetic non-conductive material positioned between the two cheek plates and engaging said spacer member. The casing is made of aluminum molded onto the fixed magnetic poles of the magnetic circuit of the pick-up assembly. The stationary magnetic poles are positioned between the cheek plates beside the spacer member so that no zone of their right section is encircled by a conductive non-magnetic material. The ends of the stationary magnetic poles of the pick-up assembly are diametrically opposite each other and positioned at the ends of the spacer member of the casing. Between the casing and the rotor arm is a magnetic screen consisting, for example, of a piece of magnetic sheet material having a surface perpendicular to the shaft which is at least equal to that of the casing and comprising at least one protuberance positioned in alignment with at least one of the distribution terminals of the distributor cap. The magnetic screen positioned between the cassette and the rotor arm which sweeps the distribution terminals for the high voltage current carried by the distributor cap comprises pointed protuberances stamped therein, for example, in alignment with each of the distribution terminals for the high voltage current on the cap of the distributor.

Centrifugal advance means is positioned inside the casing. This means comprises, for example, movable weights subjected to the action of at least one spring and rotated by the distributor shaft. Between the casing and the centrifugal advance means is a magnetic screen consisting, for example, of a stationary member of magnetic sheet material having in a surface perpendicular to the shaft at least as large as that of the casing. Between the outer ends of the stationary poles of the magnetic circuit of the pick-up assembly is a magnetic core encircled by an induction coil, a permanent magnet being positioned between the magnetic core and one of the stationary magnetic poles. The ends of the stationary magnetic poles which embrace the induction coil have plane substantially parallel surfaces, the magnetic core of the induction coil being made in the form of a rod, the length of which is less than the distance separating the two parallel plane surfaces of said stationary magnetic poles. The end of the rod is engaged in an orifice formed in one of the stationary magnetic poles and bears against a shoulder on this pole, while the head of the rod facing the plane surface of the other stationary magnetic pole is held in position by the permanent magnet associated with the magnetic core, said magnet having a suitable thickness and being inserted between the head of the pin and the plane surface of the stationary pole thereopposite. The pick-up assembly cooperates through its cheek plates with the actuating rod of vacuum-responsive advance means, preferably carried by the lateral surface of the casing of the ignition distributor.

It has been found that, in the embodiment according to the invention, all of the disadvantages due to friction between the timer core and a cylindrical bearing surface made of a plastic material have been eliminated. In effect, the rotation of the timer core in the casing of the pick-up assembly is in self-lubricating bearing rings in alignment with the cheek plates of the casing, that is to say, on opposite sides of the timer core. It should be noted that the bearing surfaces which cooperate with the bearing rings may have a smaller diameter than that of the timer core, which makes it possible to decrease the linear speed of frictional engagement and consequently improve the longevity of the casing. Moreover, the distributor according to the invention makes it possible to eliminate the disadvantages which were inherent in the use of a plastic material for the manufacture of the casing, and in particular the dimensional variations in response to temperature and the absorption of humidity. The use of an arcuate sealing member made of a plastic material in alignment with the timer core makes it possible to enclose the timer core in a perfectly sealed seat so as to avoid any risk of penetration by magnetic particles into the magnetic gap in the magnetic circuit of the pick-up assembly. The sealing member being of a plastic material, there is no conductive loop about the ends of the stationary magnetic poles and consequently there are no eddy currents about the magnetic poles. Since the stationary magnetic poles are molded into the aluminum cassette, they cannot move in response to vibrations of the motor and can never come into contact with the moving magnetic poles of the timer core.

It should also be noted that, if the common axis of the two bearing rings of the cassette is not strictly the same as the axis of the timer core, this does not necessarily interfere with operation, since only the total value of the gap between the poles of the timer core and the stationary magnetic poles has a significant effect on the operation of the magnetic circuit and, if the two magnetic gaps on opposite sides of the timer core are not exactly equal there is no variation in the operation of the pick-up assembly.

Furthermore, the fact that magnetic screens have been provided on opposite sides of the casing makes it possible to avoid any influence on the operation of the magnetic circuit by the movable centrifugal advance weights or the sparks passing between the rotor arm and the high voltage terminals of the distributor cap. Finally, the protuberances carried by the upper magnetic screen make it possible to avoid the creation of a spark between the rotor arm and the edge of the housing which carries the distributor cap. This avoids any probability of creating a carboniferous conductive path on the inner wall of the distributor cap which is made of plastic material and therefore the deterioration of said distributor cap.

The timer core of the distributor according to the invention, together with its two associated bearing surfaces, may be made in one piece or in two pieces assembled together. When the timer core and the bearing surfaces are formed on a single piece, the timer core may be made by free-cutting, the profile of the timer core itself being obtained by broaching. When the timer core and its bearing surfaces are made in two parts, the timer core itself may be made by sintering or cutting off a shape, said core being then threaded onto the central part of a straight tube, the ends of which form the bearing surfaces.

It should also be noted that the particular structure adopted in the preferred embodiment of the invention, insofar as it relates to the magnetic core of the induction coil, makes it particularly easy to mount the different parts of the magnetic circuit. In particular, the two stationary poles molded into the casing have two substantially parallel end faces, one of which comprises an orifice. The rod which constitutes the magnetic core is inserted into the central cylindrical recess in the induction coil and the end of the rod is introduced into the above-mentioned orifice in the end face of the magnetic pole. This introduction is rendered possible by the fact that the total length of the rod is less than the distance between the two end faces of the stationary magnetic poles. A space then remains between one end of the rod and the face of the magnetic pole which does not have an orifice therein. A permanent magnet of a corresponding thickness is then inserted into this space. The permanent magnet holds the magnetic core and its associated coil in position and the magnet is itself held in position by magnetic force. Preferably a magnet is used which is a tight fit between the head of the pin and the face of the pole thereopposite.

It is known that all the components of a distributor are threaded onto the distributor shaft one above the other, so that if the rotor arm is dependent for its vertical position on the stack of components which it surmounts there is a certain uncertainty as to the positioning of the rotor arm with respect to the contacts carried by the distributor cap. Therefore, in such an ignition distributor in which the casing of the stationary magnetic poles is centered on the shaft, it is known that a false roundness of the shaft may occur in case of wear of its bearing surfaces, which false roundness may in practice prevent radial displacement. The displacement must then take place parallel to the axis of the distributor and any uncertainty as to the position of the rotor arm with respect to the contacts of the distributor cap leads to an uncertainty as to the resistance to the passage of high voltage current between said rotor arm and said contacts. For this reason means have been provided for adjusting the vertical position of the rotor arm.

It is also known that when an ignition distributor has been mounted on a motor, the advance of the ignition is generally adjusted stroboscopically by establishing for a given speed of rotation of the motor the coincidence, at each ignition, of a movable timing mark fixed to the crankshaft of the motor and a stationary timing mark carried by the motor block. However, in order that this stroboscopic adjustment may be carried out, it is necessary that it be possible to turn the motor, so that it is necessary to be able to preadjust the ignition in a simple way so as to permit the rotation of the motor. When the ignition distributor comprises breaker points, this preadjustment may be obtained by observing the relative position of the stationary contact and the movable contact of these points. In the distributor according to the present invention this method of operation is totally impossible since the timer core is hidden from the eye of the observer. It is thus necessary to provide presetting means adjusted to the distributor according to the invention.

According to the invention these two problems are solved by positioning the rotor arm on the shaft of the distributor by means of a sleeve force fitted onto the end of the shaft, which sleeve is placed in position after having located all the parts of the distributor in the housing. The rotor arm comprises an internal seat in which the sleeve is received, while the sleeve comprises a notch which receives a projection provided on the inside of the seat in the rotor arm. The vertical position of the sleeve is adjusted with respect to a point on the housing and the angular position of the sleeve on the shaft is adjusted with respect to a point on the shaft.

With respect to the vertical positioning of the sleeve, it should be noted that it renders the spark gap independent of the stack of components inside the housing. In effect, since the position of the sleeve is adjusted with respect to the edge of the housing, the distance between the rotor arm and each of the contacts carried by the distributor cap is affected only by the tolerances resulting from the manufacture of the rotor arm, on the one hand, and the distributor cap on the other hand, since the lower edge of said cap rests on the upper edge of the housing.

Turning now to the adjustment of the angular position of the sleeve with respect to the shaft, it should be noted that it permits the positioning of the rotor arm with respect to the teeth of the timer core. The distributor cap is located with respect to the housing in the same way as the casing so that, by construction, when the rotor arm is opposite a contact of the distributor cap, one of the teeth of the timer core is opposite a stationary magnetic pole in the casing.

When it is desired to establish a predetermined timing when mounting the ignition distributor, it is necessary that when the motor has a cylinder at top dead center, the housing of the distributor be at a predetermined position with respect to the shaft. To bring this about, in accordance with the invention, the magnetic screen positioned between the casing and the rotor arm is fixed to the housing and carries at least one mark. The rotor arm also carries at least one external mark. The magnetic screen is attached to the housing by means of a prong-carrying member fixed to the housing, with the prongs of this member penetrating into appropriate orifices formed in the magnetic screen. The prongs in the corresponding orifices are two in number and are so positioned that they are not symmetrical with respect to each other about a plane passing through the axis of the distributor and perpendicular to a line connecting the centers of the orifices. The prong-carrying member is supported by the member which attaches the vacuum pump to the housing.

The advantage of an assymetric position for the two prongs is to require proper mounting of the magnetic screen above the distributor so that, during mounting, one is certain to position the protuberances provided on this screen in the direction of the contacts in the distributor cap. The marks which are located on the upper magnetic screen of the distributor are in general lines which extend radially along the upper surface of the magnetic screen and the rotor arm carries as its mark a projection parallel to its axis.

For any given motor it suffices to provide a single mark on the upper magnetic screen, but because the timing of the ignition of motors of different types using the same ignition distributor may be different, several marks, each appropriate to one of said motors, may be provided on the upper magnetic screen.

In order to preadjust the distributor, the distributor is mounted on its motor by engaging the end of the shaft of the distributor in the connecting member which is driven by the motor, and the motor is brought to the high dead center position of the cylinder corresponding to the motor mark. The cap of the distributor is removed and the housing is then turned to bring the mark carried by the upper magnetic screen and corresponding to the motor in question opposite the mark externally carried by the rotor arm. Since the stationary magnetic poles have a predetermined angular position with respect to the housing and the upper magnetic screen, and since the rotor arm has a predetermined position with respect to the teeth of the timer core, as has been previously explained, this insures a predetermined relative position between the stationary magnetic poles and the teeth of the timer core or the top dead center position of the crankshaft.

This determines the position of the housing with respect to the motor block and the distributor cap is then replaced. This preregulation makes it possible to start the motor without difficulty preparatory to subsequent stroboscopic regulation.

In order that the object of the invention may be better understood a preferred embodiment will now be described, purely by way of illustration and example, with reference to the accompanying drawings on which:

Figure 1:
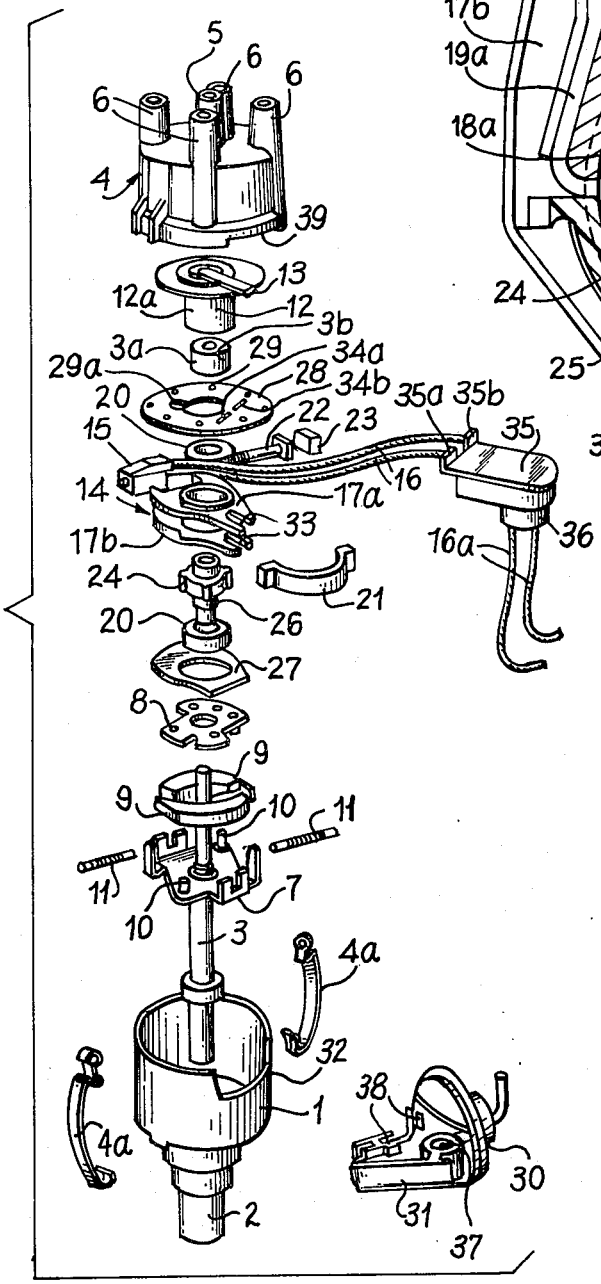
FIG. 1 is an exploded perspective view showing the various components of the distributor according to the invention.
Figure 2:
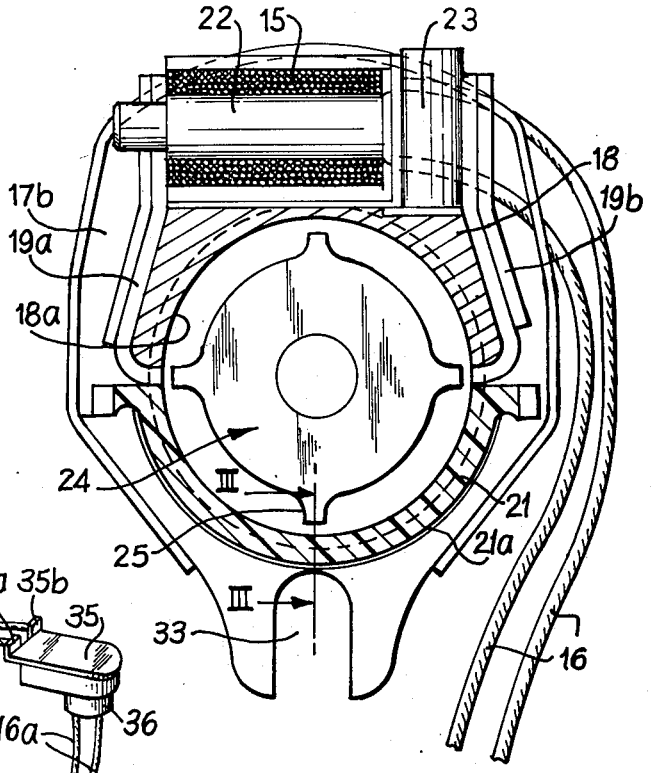
FIG. 2 is a sectional view on an enlarged scale taken through the casing of the distributor according to the invention, perpendicularly to the shaft of the distributor, between the two cheek plates of said casing, with the timing core in position therein.

Referring now to the drawings, it will be seen that reference numeral 1 indicates the housing of the distributor according to the invention. The housing 1 is generally cylindrical in shape and has at its lower end, as seen in FIG. 1, a sleeve 2 in which the shaft 3 of the distributor rotates. Its opposite end cooperates with a distributor cap 4 comprising a central terminal 5 adapted to receive the high voltage current from the secondary winding of the ignition coil associated with the distributor and four peripheral terminals 6 for distributing this high voltage current to the four spark plugs of the internal combustion engine with which the ignition distributor is associated. The cap 4 is fastened to the housing 1 by two external connectors 4*a*.

Inside the casing 1 is a centrifugal advance mechanism comprising a driving plate 7 fixed to the shaft 3 and a driven plate 8, two pivotally mounted weights 9 being carried by the pins 10 on the driving plate 7 and controlling the rotation of the driven plate 8 relative to that of the driving plate 7 in response to centrifugal force, which moves them away from their rest position. The weights 9 are also biassed by a draw spring 11 which resists the action of centrifugal force.

Inside the distributor cap 4 is a rotary switch 12. The rotor 12 comprises at its bottom a cylindrical internal seat provided with a projection extending along one of its generatrices. The rotor 12 is carried by a sleeve 3*a* which comprises a radial notch 3*b* which receives the internal projection from the rotor 12 when the sleeve 3*a* is positioned in the seat in said rotor. The sleeve 3*a* is force fitted onto the end of the shaft 3 after complete mounting of the distributor so that the sleeve 3*a* has a predetermined vertical position with respect to the upper edge of the housing 1 and so that the notch 3*b* has a predetermined angular position with respect to a reference point on the shaft 3. The rotor 12 carries a conductor 13 which is in contact with the contact of the terminal 5 and the end of which moves to successively engage the corresponding contacts of the four terminals 6. Moreover, the rotor 12 has an external projection 12*a* extending along a generatrix of its vertical cylindrical part.

Between the centrifugal advance mechanism described above and the rotor is mounted a pick-up assembly which comprises a casing 14 containing a magnetic circuit. This magnetic circuit comprises an induction coil 15, the winding of which supplies through conductor 16 an electronic device (not shown on the drawing) capable of opening and closing the supply circuit for the primary winding of the ignition coil associated with the distributor according to the invention.

The casing 14 is made of a single piece of molded aluminum. It comprises two parallel identical cheek plates 17*a*, 17*b* connected to each other by a spacer 18, one edge 18*a* of which has the form of a cylinder segment.

Figure 3:
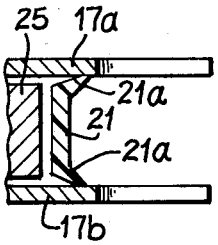
FIG. 3 is a partial sectional view taken along the line III—III of FIG. 2.
Figure 4:
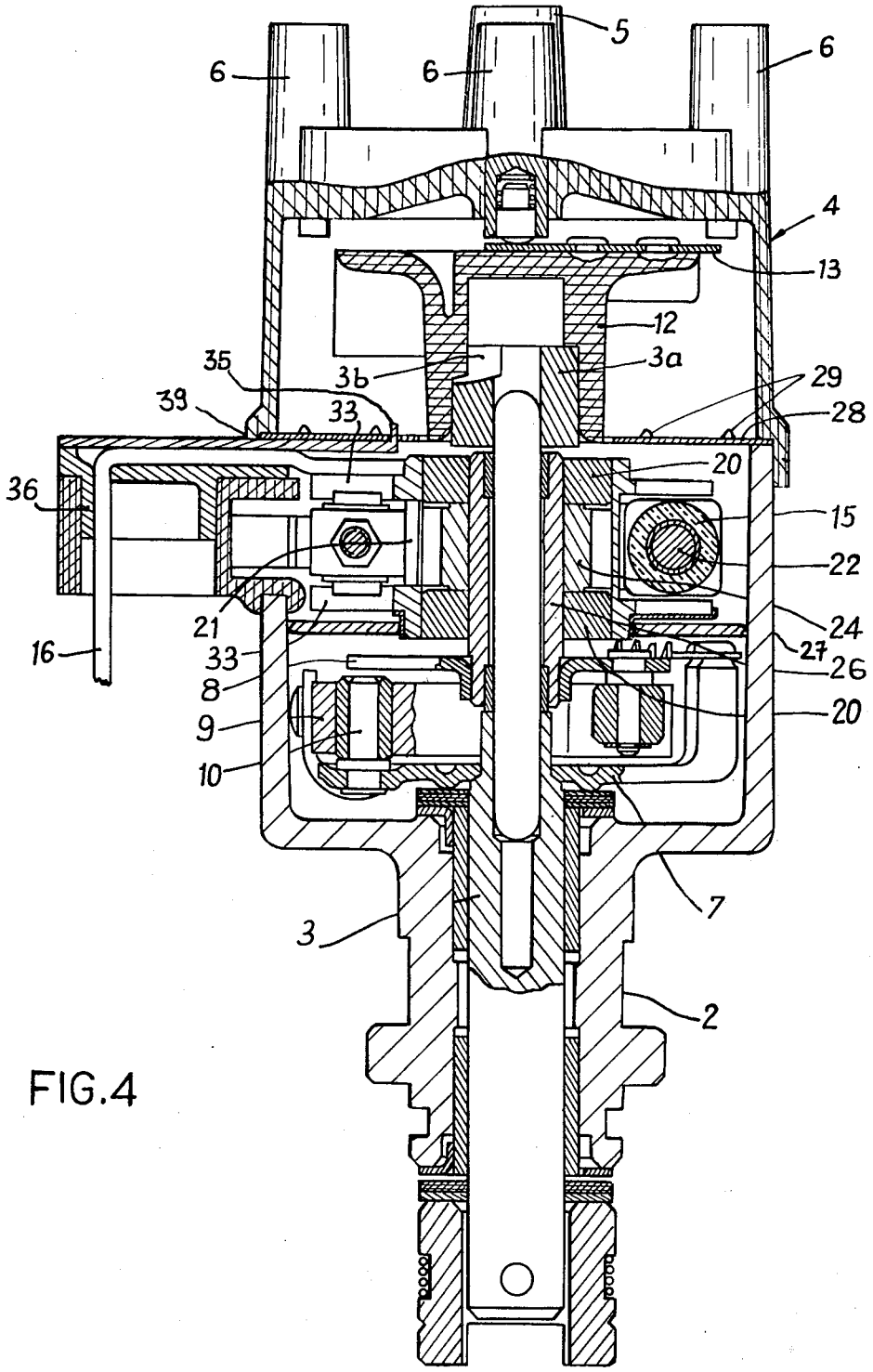
FIG. 4 is an axial sectional view taken through the assembled distributor.

Between the two cheek plates 17*a* and 17*b* and embracing the spacer 18 are stationary magnetic poles 19*a*, 19*b*, the ends of which lie flush with the cylindrical surface 18*a*. The cylindrical sector 18*a* thus formed has semi-circular right section. In the central zone of each of the cheek plates 17*a*, 17*b* is a cylindrical seat which receives a sintered bronze bearing ring 20. The casing 14 is also associated with an arcuate sealing member 21 made of plastic material, which fits against the ends of the poles 19*a*, 19*b* so as to form the second half of the cylindrical circular chamber partially defined by the surface 18*a* of spacer member 18. On the edges of the sealing member 21 adjacent the cheek plates 17*a*, 17*b* are tongues 21*a* projecting away from the timer core 24 (see FIG. 3). These tongues 21*a* make it possible to hold the sealing member in position when it has been inserted between the two cheek plates 17*a*, 17*b* and to insure the sealing of the timer core 24 within the casing 14. The two cheek plates 17*a*, 17*b* and the spacer member 18 are made of molded aluminum and molded around two magnetic poles 19*a*, 19*b* which are elongated and made of a magnetic material. Between those ends of the poles 19*a*, 19*b* which are not adjacent the cylindrical surface 18*a*, a magnetic core 22 is positioned. This core is encircled by the winding 15 and adjoins a permanent magnet 23. The magnetic core 22 is shaped like a rod, one end of which is engaged in an orifice formed in the end of the pole 19*a*. The two ends of the poles 19*a*, 19*b* are substantially flat and parallel. When the end of the rod 22 is located in said orifice, its location is assured by the cooperation between a shoulder on the road and one on the pole 19*a* and the head of the rod is parallel to the end of the pole 19*b*. When the rod 22 encircled by its coil 15 is mounted as above indicated, the permanent magnet 23 is inserted between the head of the rod and the pole 19*b* to hold the assembly in place and is itself held in position by magnetic force. In the cylindrical chamber defined by the surface 18*a*, the ends of the poles 19*a*, 19*b* and the sealing sector 21 is positioned a timer core 24 having four poles 25 positioned 90° apart. The time core 24 is made of soft sintered iron and is threaded onto the central part of a tube 26 which is externally adapted to receive it, the ends of said tube constituting bearing surfaces which cooperate with the bearing rings 20 of the casing 14. The dimensions of the movable poles 25 are so determined as to leave between these poles and the cylindrical seat in which the timer core is located a clearance sufficient to avoid any friction. When two poles 25 diametrically opposite each other are positioned opposite the two stationary poles 19*a*, 19*b*, the sum of the clearances existing in alignment with each of the poles 25 constitutes the magnetic gap in the magnetic circuit formed by the pole 19*a*, the core 22, the magnet 23, the pole 19*b*, and the timer core 24.

Between the casing 14 and the centrifugal advance mechanism is a magnetic screen 27 consisting of a stationary plate made of magnetic sheet material. Between the casing 14 and the rotor arm 12 is also a magnetic screen 28 consisting of a stationary circular annular plate on the upper face of which are stamped protuberances 29 in the form of points which are in alignment with radial lines 29*a* constituting angular position markers. In the magnetic screen 28 are also two rectangular orifices 34*a*, 34*b* adapted to cooperate respectively with the prongs 35*a*, 35*b*, of a prong-carrying member 35. The orifices 34*a*, 34*b* are so positioned that they are assymetrical with respect to a plane passing through the axis of the magnetic screen 28 and perpendicular to the line which joins the centers of the orifices 34*a*, 34*b*. Consequently, the magnetic screen 28 cannot be mounted on the member 35 unless the protuberances 29 are upwardly directed.

The casing 14 is responsive to the movement of the control rod of a vacuum advance unit which comprises a vaccum motor 30. The motor 30 is carried by a plastic supporting member 31 on the lateral wall of the casing, the support 31 being located in a seat 32 in said lateral wall at the upper part of the casing.

The control rod actuated by the mtor 30 has its end seated in the notches 33 formed in the edge of the cheek plates 17*a*, 17*b* of the casing 14. It is thus possible to move the casing 14 from its original set position and adjust the distributor according to the invention by means of a vacuum type advance of a conventional type. The prong-carrying member 35 is carried by the support 31 and receives the ends of the wires 16 connected to the windings 15, said wires being indicated by reference numeral 16*a* at the outlet from the member 35. The member 35 has a cylindrical bearing surface 36 which is seated inside a cylindrical recess 37 in the support 31. When the support 31 is fixed to the housing 1 the position of the prongs 35*a*, 35*b* and consequently that of the screen 28 are angularly determined with respect to the housing.

When the shaft 3 of the distributor is rotated by the motor inside the housing 1, the shaft rotates the timer core 24 so that, after each 90° of rotation, the magnetic gap existing in the magnetic circuit of the casing 14 is reduced to the sum of the distances between two diametrically opposite poles 25 on the one hand and the two stationary poles 19*a*, 19*b* on the other hand. Except in this position, the gap is much greater so that there is a variation in magnetic flux in the circuit, and in particular in the core 22, which variation induces in the winding 15 a current capable of causing the opening and/or the closing of the supply line to the primary winding of the ignition coil associated with the distributor according to the invention. This variation in magnetic flux is not disturbed by the movement of the weights 9 because of the presence of the magnetic screen 27. At the same time this variation is not disturbed by the sparks which are produced between the rotor arm 13 and the contacts of the terminal 6 because of the magnetic screen 28.

When the rotor arm 13 is supplied with high voltage current, it may happen under certain conditions of operation that the breaking spark has a tendency to travel in the direction of the upper edge of the housing 1, on which the lower edge of the cap 4 rests. In this case, since the cap 4 is made of a plastic insulating material, there is a risk that the plastic material of the inner wall of cap 4 may be carbonized so as to initiate the formation of a conductive point. Progressively a conductive path may thus be created on the inside of the cap 4 from the lower edge of this cap toward the zone where the high voltage distribution terminals are located. This renders the distributor cap unusable because the ignition spark is diverted from the distributor contacts. In order to avoid this disadvantage, the device according to the invention has been provided with pointed protuberances 29 on the upper surface of the magnetic screen 28. When the ignition spark has a tendency to pass in the direction of the upper edge of the housing, it is attracted by the points 29 and does not touch the inner edge of the cap 4 of the distributor. The magnetic screen 28 is thus used to improve the longevity of the distributor cap 4.

It should be noted that the rotation of the ends of the tube 26 in the bearing rings 20 of the casing 14 takes place about a relatively small radius as compared with the outer radius of the timer core 24 so that the linear speed of rotation is reduced as compared with that which existed in the embodiment of French Pat. No. 1,538,395. Moreover, this friction takes place in a bearing of a self-lubricating bronze which avoids all the disadvantages which have been found when friction occurs between the movable poles of the timer core 24 and a cylindrical surface of plastic material. Moreover, the cheek plates 17*a*, 17*b* and the spacer member 18 of the casing 14 are made of aluminum which avoids any deformation in response to changes in temperature or absorption of humidity. The stationary pole pieces 19*a*, 19*b* which have sections which are not completely encircled by the aluminum of the casing 14 do not produce any eddy currents capable of provoking local increases in temperature. The stationary magnetic poles 19*a*, 19*b* being nevertheless molded into the aluminum of the casing 14 can under no circumstances become displaced with respect to the cheek plates 17*a*, 17*b* in response to vibrations of the motor. Finally, the timer core 24 moves in a sealed cylindrical chamber which is closed not only at it periphery by the spacer 18 and the segment 21, but also by the bearing rings 20 at its top and bottom. It follows that no magnetic metal particles can penetrate into the magnetic gap, which avoids any disturbance in the operation of the magnetic circuit.

It should be noted that because of the sleeve 3*a* is mounted on the shaft 3 at a predetermined vertical position with respect to the upper edge of the housing 1, the distance between the rotor arm 13 and the contacts of the terminal 6 is not affected by the tolerances of the stack of distributor components inside the housing. In effect, the spark gap becomes a function of the tolerances of manufacture of the rotor arm and the distributor cap.

Because of the angular position of the sleeve 3*a* on the shaft 3, the position of the rotor arm 13 is determined relative to the teeth 25 on the timer core 24. Thus, in the absence of action by the vacuum motor 30, the position of the magnetic poles in the casing 14 is also determined relative to the housing, and the position of the cap 4 is determined relative to the housing by the notch 32 receiving the support 31 provided with the projections 38 which cooperate with the notch 39 in the cap 4. The position of the contacts of each terminal 6 is thus determined with respect to the position of the stationary magnetic poles of the casing 14 and thus, by construction, when a pole tooth 25 is opposite a stationary magnetic pole, the rotor arm 13 is opposite a contact.

In order to preadjust a distributor according to the invention, when it is mounted on a motor, the base of the shaft 3 is engaged in the connecting member through which it is driven by the motor, and the motor is located at the top dead center point of a cylinder. The housing 1 is then turned with respect to the motor so as to bring the mark 29*a* corresponding to the ignition point of the motor which is associated with the distributor opposite the projection 12*a* of the rotor arm 12. This rotation of the housing with respect to the shaft 3 makes it possible to locate in a predetermined fashion the pole teeth 25 with respect to the stationary magnetic poles of the casing 14. The alignment of the mark 28 is thus brought about so as to obtain the desired ignition setting. This system of preadjustment makes it possible to insure starting of the motor in order to obtain definitive final adjustment by stroboscopic means in a well known manner.

It will of course be appreciated that the embodiment hereinbefore described has been given purely by way of example and may be modified as to detail without thereby departing from the basic principles of the invention.

What is claimed is:

1. In an ignition distributor adapted to be supplied by an ignition coil, said distributor comprising a housing, a drive shaft in said housing, a distributor cap for said housing which carries an input terminal and a plurality of output terminals, and a rotor arm driven by said shaft for successively connecting each output terminal to said input terminal; and a pick-up assembly in which said shaft rotates, said assembly comprising a timer core fixed to said shaft, a magnetic circuit having stationary poles positioned in alignment with said timer core, an induction coil coupled to said magnetic circuit to produce electrical pulses for controlling the opening and closing of the supply circuit of said ignition coil as said timer core rotates, and two substantially parallel non-magnetic cheek plates encircling said shaft on opposite sides of said timer core, the improvement which comprises two bearing surfaces one on each side of and fixed to the timer core, and bearing means positioned between said bearing surfaces and the cheek plates of the pick-up assembly.

2. Distributor as claimed in claim 1 in which each bearing means is annular in shape.

3. Distributor as claimed in claim 1 in which the pick-up assembly comprises a casing made of said two cheek plates connected together by a spacer member, one edge of which at least partially defines a cylindrical chamber within which the timer core rotates.

4. Distributor as claimed in claim 3 in which the ends of the stationary magnetic poles of the pick-up assembly are diametrically opposite each other and are positioned at the ends of the spacer member of the casing.

5. Distributor as claimed in claim 1 comprising a magnetic core between said stationary magnetic poles, said induction coil being wound around said core and a permanent magnet being located between the magnetic core and one of the stationary magnetic poles.

6. Distributor according to claim 1 in which the pick-up assembly is connected to be rotated by the control rod of a vacuum advance device.

7. In an ignition distributor adapted to be supplied by an ignition coil, said distributor comprising a housing, a drive shaft in said housing, a distributor cap for said housing which carries an input terminal and a plurality of output terminals, and a rotor arm driven by said shaft for successively connecting each output terminal to said input terminal; and a pick-up assembly in which said shaft rotates, said assembly comprising a timer core fixed to said shaft a magnetic circuit having stationary poles positioned in alignment with said timer core, an induction coil coupled to said magnetic circuit to produce electrical pulses for controlling the opening and closing of the supply circuit of said ignition coil as said timer core rotates, and two substantially parallel non-magnetic cheek plates encircling said shaft on opposite sides of said timer core, the improvement according to which the pick-up assembly comprises a casing molded in a single piece from a non-magnetic metal, said casing comprising said two cheek plates connected by a spacer, and an arcuate non-conductive, non-magnetic sealing member positioned between said cheek plates and bearing against the spacer, with said spacer and arcuate sealing member each partially defining the periphery of a cylindrical chamber in the central part of said casing within which chamber said timer core rotates, and said assembly further comprises two bearing surfaces, one on each side of the timer core, and bearing means positioned between said bearing surfaces and said cheek plates.

8. Distributor as claimed in claim 7 in which said casing is made of aluminum molded about said stationary magnetic poles, which are positioned between the cheek plates and the ends of the spacer member so that they are nowhere completely encircled by a conductive material.

9. In an ignition distributor adapted to be supplied by an ignition coil, said distributor comprising a housing, a drive shaft in said housing, a distributor cap for said housing which carries an input terminal and a plurality of output terminals, and a rotor arm driven by said shaft for successively connecting each output terminal to said input terminal; and a pick-up assembly in which said shaft rotates, said assembly comprising a timer core fixed to said shaft, a magnetic circuit having stationary poles positioned in alignment with said timer core, an induction coil coupled to said magnetic circuit to produce electrical pulses for controlling the opening and closing of the supply circuit of said ignition coil as said timer core rotates, and two substantially parallel non-magnetic cheek plates encircling said shaft on opposite sides of said timer core, the improvement according to which the pick-up assembly comprises a casing made of said two cheek plates connected together by a spacer member, one edge of which at least partially defines a cylindrical chamber within which the timer core rotates, two bearing surfaces, one on each side of the timer core, and bearing means positioned between said bearing surfaces and said cheek plates, and said distributor further comprises a magnetic screen between the casing and the rotor arm consisting of a stationary piece of magnetic sheet material having, in a plane perpendicular to said shaft, a surface at least equal to that of the casing and comprising at least one protuberance substantially in alignment with one of the output terminals of the distributor cap.

10. Distributor as claimed in claim 9 in which the rotor arm defines a hollow seat provided with an internal projection, said distributor comprising a sleeve which fits into said seat, and said sleeve defining a notch which receives the internal projection and being force fitted upon the end of said distributor shaft, said sleeve being mounted in a predetermined axial position with respect to the housing and with the notch of the sleeve in a predetermined angular position with respect to the shaft, said distributor further comprising a magnetic screen fixed to the housing between the casing and the rotor arm and carrying at least one timing mark, the rotor arm also carrying at least one external mark.

11. Distributor according to claim 10 comprising a prong-carrying member fixed to the housing and by means of which the magnetic screen between the casing and rotor arm is fastened to the housing, the prongs of said member fitting into mating orifices in the magnetic screen.

12. Distributor as claimed in claim 11 in which the prongs in the corresponding orifices are two in number and so positioned that they are assymetrical with respect to a plane passing through the axis of the distributor and perpendicuar to a line connecting the centers of said orifices.

13. Distributor as claimed in claim 11 further comprising a vacuum motor, and a member connecting both said motor and said prong-carrying member to the housing.

14. In an ignition distributor adapted to be supplied by an ignition coil, said distributor comprising a housing, a drive shaft in said housing, a distributor cap for said housing which carries an input terminal and a plurality of output terminals, and a rotor arm driven by said shaft for successively connecting each output terminal to said input terminal; and a pick-up assembly in which said shaft rotates, said assembly comprising a timer core fixed to said shaft, a magnetic circuit having stationary poles positioned in alignment with said timer core, an induction coil coupled to said magnetic circuit to produce electrical pulses for controlling the opening and closing of the supply circuit of said ignition coil as said timer core rotates, and two substantially parallel non-magnetic cheek plates encircling said shaft on opposite sides of said timer core, the improvement according to which the pick-up assembly comprises a casing made of said two cheek plates connected together by a spacer member, one edge of which at least partially defines a cylindrical chamber within which the timer core rotates, two bearing surfaces, one on each side of the timer core, and bearing means positioned between said bearing surfaces and said cheek plates, and said distributor comprises a centrifugal advance mechanism positioned inside the housing, said mechanism comprising movable weights biassed by at least one spring and driven by the distributor shaft, and a magnetic screen between said casing and centrifugal advance mechanism.

15. In an ignition distributor adapted to be supplied by an ignition coil, said distributor comprising a housing, a drive shaft in said housing, a distributor cap for said housing which carries an input terminal and a plurality of output terminals, and a rotor arm driven by said shaft for successively connecting each output terminal to said input terminal; and a pick-up assembly in which said shaft rotates, said assembly comprising a timer core fixed to said shaft a magnetic circuit having stationary poles positioned in alignment with said timer core, an induction coil coupled to said magnetic circuit to produce electrical pulses for controlling the opening and closing of the supply circuit of said ignition coil as said timer core rotates, and two substantially parallel non-magnetic cheek plates encircling said shaft on opposite sides of said timer core, the improvement which comprises two bearing surfaces one on each side of the timer core, bearing means positioned between said bearing surfaces and the cheek plates of the pick-up assembly, a magnetic core between said stationary magnetic poles, said induction coil being wound around said core and a permanent magnet being located between the magnetic core and one of the stationary magnetic poles, said stationary magnetic poles having parallel flat surfaces at opposite ends of the induction coil and said magnetic core being made in the form of a rod shorter than the distance separating the two said flat parallel surfaces of the magnetic poles, one end of the rod engaging in an orifice formed in one of the magnetic poles and bearing against this pole by means of a shoulder, while the other end of the rod is positioned opposite the flat face of the other stationary magnetic pole and said distributor further comprises a permanent magnet associated with the magnetic core, said magnet fitting tightly between said other end of the rod and the flat surface of the adjacent stationary pole to hold said other end of said rod in position.

16. In an ignition distributor adapted to be supplied by an ignition coil, said distributor comprising a housing, a drive shaft in said housing, a distributor cap for said housing which carries an input terminal and a plurality of output terminals, and a rotor arm driven by said shaft for successively connecting each output terminal to said input terminal; and a pick-up assembly in which said shaft rotates, said assembly comprising a timer core fixed to said shaft, a magnetic circuit having stationary poles positioned in alignment with said timer core, an induction coil coupled to said magnetic circuit to produce electrical pulses for controlling the opening and closing of the supply circuit of said ignition coil as said timer core rotates, and two substantially parallel non-magnetic cheek plates encircling said shaft on opposite sides of said timer core, the improvement according to which there are two bearing surfaces, one on each side of the timer core, and bearing means are positioned between said bearing surfaces and the cheek plates of the pick-up assembly, and the rotor arm defines a hollow seat provided with an internal projection, said distributor comprising a sleeve which fits onto said seat, said sleeve defining a notch which receives the internal projection and being force fitted upon the end of said distributor shaft, and said sleeve being mounted in a predetermined axial position with respect to the housing with said notch in a predetermined axial position relative to said shaft.

* * * * *